US007825338B2

(12) United States Patent
Tonello et al.

(10) Patent No.: US 7,825,338 B2
(45) Date of Patent: Nov. 2, 2010

(54) METHOD FOR INTERCONNECTING ELECTRIC CABLES

(76) Inventors: Gino Tonello, Via San Marco, 154-31031 Caerano San Marco (IT); Mirko Tonello, Via E. Fermi, 1/A-31031 Caerano San Marco (IT)

( * ) Notice: Subject to any disclaimer, the term of this patent is extended or adjusted under 35 U.S.C. 154(b) by 325 days.

(21) Appl. No.: 12/085,955

(22) PCT Filed: Oct. 31, 2006

(86) PCT No.: PCT/EP2006/067991

§ 371 (c)(1),
(2), (4) Date: Jun. 3, 2008

(87) PCT Pub. No.: WO2007/065764

PCT Pub. Date: Jun. 14, 2007

(65) Prior Publication Data

US 2009/0229881 A1 Sep. 17, 2009

(30) Foreign Application Priority Data

Dec. 7, 2005 (IT) ..... TV2005A000192

(51) Int. Cl.
*H01R 4/00* (2006.01)

(52) U.S. Cl. ..... 174/84 R; 174/88 R; 174/90

(58) Field of Classification Search ..... 174/74 R, 174/76, 80, 74 A, 84 R, 88 R, 90
See application file for complete search history.

(56) References Cited

U.S. PATENT DOCUMENTS 6,573,484 B1 * 6/2003 Yue ..... 219/541
2006/0254799 A1 * 11/2006 Gregorek ..... 174/74 A

FOREIGN PATENT DOCUMENTS

| | | | |
|---|---|---|---|
| EP | 1 076 341 | A1 | 2/2001 |
| GB | 171 317 | A | 11/1921 |
| JP | 2004 087446 | A | 3/2004 |
| JP | 2004-087466 | A1 * | 3/2004 |

* cited by examiner

*Primary Examiner*—William H Mayo, III
(74) *Attorney, Agent, or Firm*—Modiano & Associati; Albert Josif; Daniel J. O'Byrne

(57) ABSTRACT

A method for interconnecting a first electric cable, constituted by a carbon fiber bundle enveloped in a first insulating sheath, with a second cable constituted by a metallic conductor enveloped in a second insulating sheath; the method provides for the removal of a first portion of the first sheath that covers a first end of the carbon fiber bundle, and the removal of a second portion of the second sheath that covers a second end of the metallic conductor, for an extension greater than that of the first portion. The method then provides for the spiral-like winding of the second end of the metallic conductor, starting from the first end of the first cable, until such metallic conductor affects the first sheath, and then the change of direction of advancement of the spiral defined by such second end, to provide at least one loop that covers the first sheath. The method then provides for the spiral-like winding of the metallic conductor in a direction of the first end of the bundle and the mutual alignment of the first and second cables, and then the addition of at least one layer of tin or other conductor or covering element to totally cover the second end of the metallic conductor.

5 Claims, 2 Drawing Sheets

METHOD FOR INTERCONNECTING ELECTRIC CABLES

The present invention relates to a method for the interconnection of electric cables and in particular of a first carbon fibre electric cable with a second metallic conductor electric cable.

BACKGROUND OF THE INVENTION

There are currently in use electric cables constituted by a bundle of carbon fibres enveloped in a sheath provided by an electrically insulating material, for example a silicon resin; since the carbon has an elevated resistance to heat, such carbon fibre cables have an optimal application as heating electrical resistors, for example in the area of thermocouples.

In order to provide the electrical current to such carbon fibre cables, they must be connected, at their ends, to metallic conductors, typically made of copper or aluminium, connected, directly or by means of appropriate circuits, to a power source.

It is known to provide the electrical connection between one end of the carbon fibre bundle to one end of the metallic conductor by means of a connection method, known as "crimping", that provides for the insertion of the two ends in an appropriate metallic ring, that is then pressed so as to press therein the carbon fibres and the metallic conductor, providing the electrical contact therebetween.

Such known connection method has however a great drawback: due to the very reduced mechanical resistance, in particular of tensile resistance, of the carbon fibres, only modest mechanical stresses on one or both of the cables may cause the breakage of such carbon fibres, with the consequent interruption of the electrical connection between the two cables.

In order to limit the possibility of rupture of the carbon fibres, the compression of the metallic ring should not be too elevated, which however compromises the quality of the electrical contact between the metallic conductor and the carbon fibres.

Moreover, it is not possible to connect a metallic conductor to a bundle of carbon fibres by means of soldering, since the carbon, due to its physical/chemical properties, is not adapted to be soldered.

Due to the above-mentioned drawbacks the use of such carbon fibre cables is therefore very reduced.

SUMMARY OF THE INVENTION

The aim of the present invention is to solve the described technical problems, eliminating the drawbacks of the cited prior art, by providing a method that allows to obtain an optimal electrical connection between a carbon fibre cable and a metallic conductor cable.

Within this aim, an object of the present invention is to provide a method that permits to interconnect a carbon fibre cable with a metallic conductor cable, reducing the risk of separation of the two cables even under the action of mechanical stress.

A not least object is to provide a method for interconnecting a carbon fibre cable with a metallic conductor cable that has reduced costs with respect to the known art.

This aim and these objects, as well as others that will become better apparent hereinafter, are achieved by a method for interconnecting a first electric cable, constituted by a carbon fibre bundle enveloped in a first insulating sheath, with a second cable constituted by a metallic conductor enveloped in a second insulating sheath, characterized in that it comprises the steps of:

a) removing a first portion of said first sheath that covers a first end of said bundle, and removing a second portion of said second sheath that covers a second end of said metallic conductor for an extension greater than that of said first portion;

b) spiral-like winding said second end starting from said first end of said first cable until said metallic conductor affects said first sheath;

c) changing the direction of advancement of the spiral defined by said second end of said metallic conductor to provide at least one loop that covers said first sheath;

d) spiral-like winding said metallic conductor in a direction of said first end of said bundle and mutual alignment of said first and second cables;

e) adding at least one layer of tin or other conductor or covering element to totally cover said second end of said metallic conductor.

BRIEF DESCRIPTION OF THE DRAWINGS

Further characteristics and advantages of the invention will become better apparent from the following detailed description of a preferred but not exclusive embodiment thereof, illustrated only by way of non-limiting example in the accompanying drawings, in which.

Figure 1:
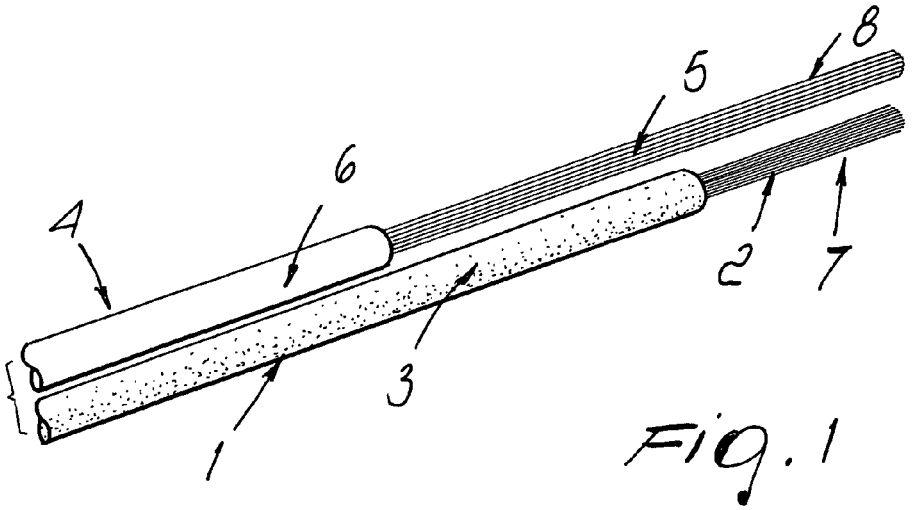
FIG. 1 is a perspective view of a carbon fibre cable and a metallic conductor cable in the first step of the interconnection method according to the invention.
Figure 2:
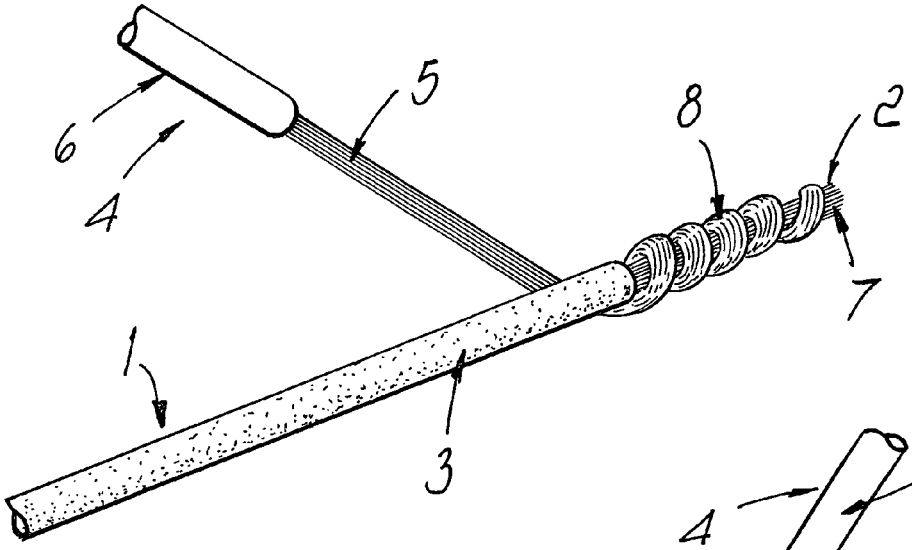
FIGS. 2, 3 and 4 are perspective views of three winding steps of the metallic conductor cable on the carbon fibre cable.

In the following embodiments, single characteristics, given in relation to specific examples, in reality may be interchanged with other different characteristics of other embodiments.

Moreover, it is to be noted that everything found to be known during the patenting procedure is not intended to be claimed and subject to a disclaimer from the claims.

DESCRIPTION OF THE PREFERRED EMBODIMENTS

With reference to the figures, a method according to the present invention allows to obtain the interconnection of a first cable 1, constituted by a carbon fibre bundle 2 enveloped in a first sheath 3 provided in an electrically insulating material, with a second cable 4, constituted by a metallic conductor 5, for example copper or aluminium, covered by a second sheath 6, provided also in an electrically insulating material.

Advantageously, at least the material that constitutes the first sheath 3 must provide, in addition to good electrical insulating characteristics, also a good mechanical resistance.

Advantageously, the first and the second sheaths may be provided in two different electrically insulating materials.

With reference to FIG. 1, the method according to the invention provides a first step in which a first portion of the first sheath 3 and a second portion of the second sheath 6, that cover respectively a first end 7 of the bundle 2 and a second end 8 of the metallic conductor 5, are partially removed, so as to leave uncovered such first and second ends.

Advantageously, the second portion of the second sheath 6 is removed for an extension that is greater than the first portion of the first sheath 3, so that the length of the uncovered portion of the metallic conductor 5 is greater than that of the uncovered portion of the bundle 2.

The second end 8 of the metallic conductor 5 is then wound in a spiral-like manner on the first cable 1, starting from the first end 7 of the bundle 2, until the metallic conductor 5 affects the first sheath 3.

Figure 3:
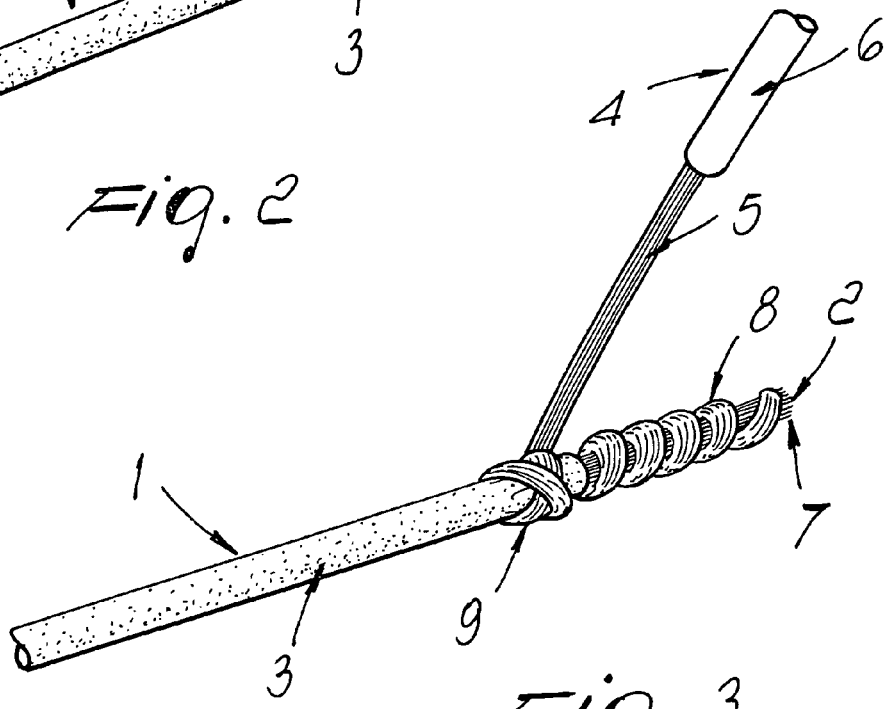

At this point, with reference to FIG. 3, the direction of advancement of the spiral defined by the second end 8 of the metallic conductor 5 is inverted, so as to provide at least one loop 9 that winds about the first sheath 3 to constitute a binding means of the metallic conductor 5 to the latter; as described previously, the sheath 3 may have a good mechanical resistance, so as to allow the maintenance of the connection between the first and the second cables even in the presence of mechanical stresses subjected thereto.

Figure 4:
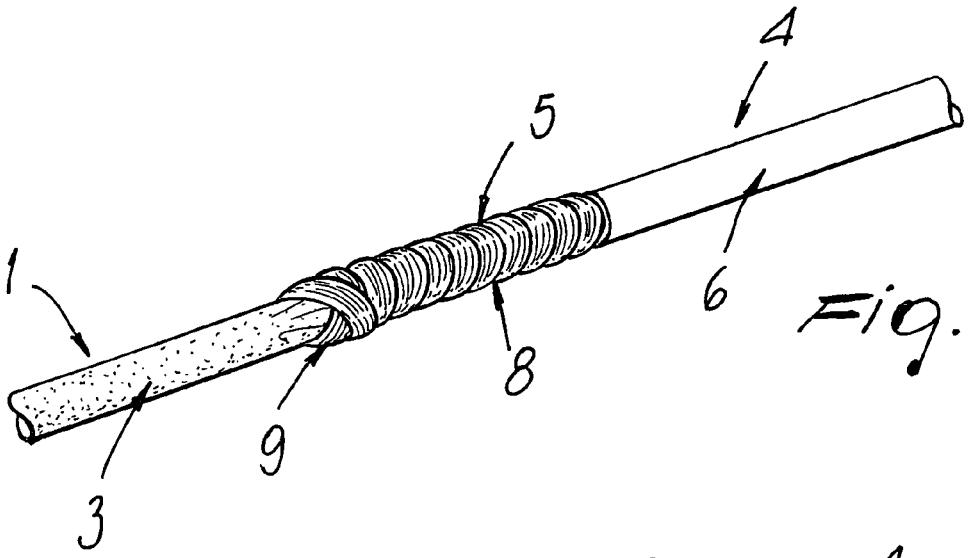

With reference to FIGS. 3 and 4, the metallic conductor 5 is then wound further in a spiral-like manner, advancing in the direction of the first end 7 of the bundle 2 and thereby going to cover substantially entirely such first end 7.

As illustrated in FIG. 4, the second cable 4 is therefore aligned with the first cable 1.

Figure 5:
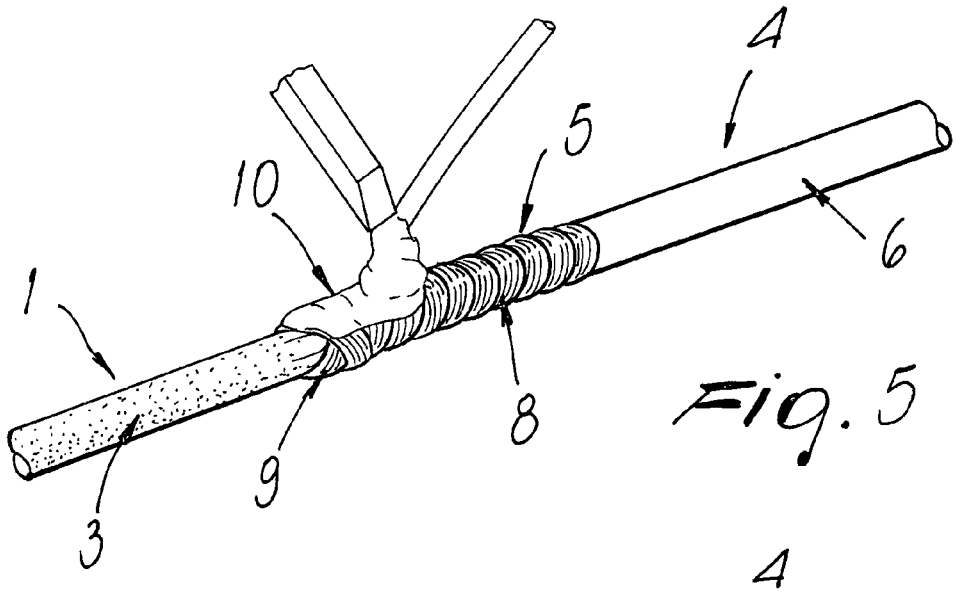
FIG. 5 is a perspective view of the step of pouring of a layer of tin.
Figure 6:
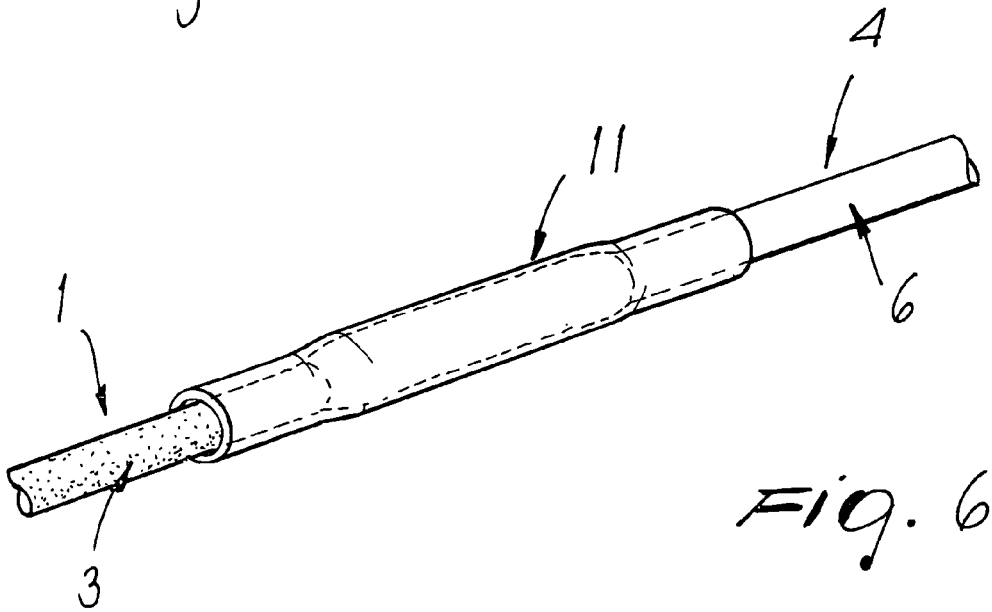
FIG. 6 is a perspective view of the two cables of the preceding figures after their mutual interconnection.

At this point, with reference to FIG. 5, at least one layer 10 of tin or other metallic conductor or covering element is arranged to cover completely the second end 8 of the metallic conductor 5, which is wound about substantially entirely the first end 7 of the bundle 2.

In the example shown in FIG. 5, the second end 8 of the metallic conductor 5 is covered with a layer 10 of tin in the liquid state.

The layer 10 does not affect, even if perhaps only slightly, the bundle 2 of carbon fibres, but instead covers completely the second end 8 of the metallic conductor 5, incorporating the same in the condition of winding of the first end 7 of the bundle 2, and guaranteeing in this manner the maintenance of the electrical connection between the latter and the metallic conductor 5.

The layer 10 is then in case closed in a heat-shrinking sheath 11, provided in an electrically insulating material, whose ends partially cover respectively the first and the second sheaths of the first and second cables, thereby electrically insulating the joining region between such cables from the external environment.

Any mechanical stresses that occur on the first cable and/or on the second cable are absorbed by the metallic conductor 5 and by the first sheath 3, that have high mechanical resistance, while the bundle 2 is not affected or only slightly affected.

It is seen therefore how the invention has achieved the proposed aim and objects, there being provided a method that allows the optimum connection, both electrical and mechanical, of a first carbon fibre cable with a second metallic conductor cable.

Moreover, the method according to the invention, delegating the mechanical hold in the connection between the two cables only to the first sheath and to the metallic conductor, and therefore not to the carbon fibres, guarantees the maintenance of the electrical connection between the two cables even in the case in which the same are subjected to mechanical stresses.

Of course the invention is susceptible to numerous modifications and variations all of which fall within the scope of the appended claims.

Naturally, the materials employed as well as the dimensions constituting the singular components of the invention may be more pertinent according to specific requirements.

The different means for carrying out certain different functions certainly do not have to exist only in the illustrated embodiment, but may be per se present in many embodiments, also not illustrated.

The characteristics indicated as advantageous, opportune or similar, may also be not present or substituted by equivalents.

The disclosures in Italian Patent Application No. TV2005A000192 from which this application claims priority are incorporated herein by reference.

What is claimed is:

1. A composite electrical cable comprising a first electric cable, constituted by a carbon fibre bundle enveloped in a first insulating sheath, and a second cable, constituted by a metallic conductor enveloped in a second insulating sheath, wherein said first and second sheaths are partially removed at a first and at a second end respectively of said first and second cables, said second sheath being removed by a portion of length greater than that of said first sheath, said second end being wound in a spiral-like manner to substantially completely cover said first end, and defining at least one loop that wraps around said first sheath to constitute a coupling means therefor, said second end being in case substantially completely coverable by at least one layer of tin or other metal or other covering element.

2. A method for interconnecting a first electric cable, constituted by a carbon fibre bundle enveloped in a first insulating sheath, with a second cable constituted by a metallic conductor enveloped in a second insulating sheath, comprising the steps of:

a) removing a first portion of said first sheath that covers a first end of said bundle, and removing a second portion of said second sheath that covers a second end of said metallic conductor for an extension greater than that of said first portion;

b) spiral-like winding said second end starting from said first end of said first cable until said metallic conductor affects said first sheath;

c) changing the direction of advancement of the spiral defined by said second end of said metallic conductor to provide at least one loop that covers said first sheath;

d) spiral-like winding said metallic conductor in a direction of said first end of said bundle and mutually aligning said first and second cables;

e) adding at least one layer of tin or other conductor or covering element to totally cover said second end of said metallic conductor.

3. The method of claim 2, wherein said at least one layer is closed in a heat-shrinking sheath, provided in an electrically insulating material, whose ends partially cover respectively said first and second sheaths.

4. The method of claim 2, wherein said first insulating sheath is provided in silicon resin having good electrically insulating properties and a good mechanical resistance.

5. The method of claim 2, wherein said layer completely covers said second end of said metallic conductor incorporating the same in the winding condition of said first end of said bundle.

* * * * *